US009079066B1

(12) United States Patent
Blessing

(10) Patent No.: US 9,079,066 B1
(45) Date of Patent: Jul. 14, 2015

(54) SKI MOTION SIMULATOR MECHANISM FOR A SKI MOTION EXERCISE MACHINE

(71) Applicant: Daniel Blessing, Cincinnati, OH (US)

(72) Inventor: Daniel Blessing, Cincinnati, OH (US)

( * ) Notice: Subject to any disclaimer, the term of this patent is extended or adjusted under 35 U.S.C. 154(b) by 105 days.

(21) Appl. No.: 14/054,250

(22) Filed: Oct. 15, 2013

Related U.S. Application Data

(60) Provisional application No. 61/715,057, filed on Oct. 17, 2012.

(51) Int. Cl.
*A63B 21/00* (2006.01)
*A63B 22/04* (2006.01)

(52) U.S. Cl.
CPC ..... *A63B 22/04* (2013.01)

(58) Field of Classification Search
None
See application file for complete search history.

(56) References Cited

U.S. PATENT DOCUMENTS

| | | | | |
|---|---|---|---|---|
| 2,274,081 | A | 2/1942 | Mautin | |
| 2,969,060 | A | 1/1961 | Swanda et al. | |
| 3,941,377 | A | 3/1976 | Lie | |
| 4,023,795 | A | 5/1977 | Pauls | |
| 5,279,531 | A * | 1/1994 | Jen-Huey | 482/70 |
| 5,433,683 | A * | 7/1995 | Stevens | 482/70 |
| 5,503,610 | A | 4/1996 | Brashear et al. | |
| 5,961,423 | A | 10/1999 | Sellers | |
| 6,234,935 | B1 * | 5/2001 | Chu | 482/51 |
| 2009/0176631 | A1 * | 7/2009 | Blessing | 482/71 |

* cited by examiner

*Primary Examiner* — Jerome W Donnelly
(74) *Attorney, Agent, or Firm* — RG Patent Consulting, LLC; Rachel Gilboy

(57) ABSTRACT

A ski motion simulator mechanism for a ski motion exercise machine is a mechanism that can be retrofitted to an existing ski motion exercise machine or may be installed on new machines by the manufacturer. The device utilizes a weighted flywheel and pulley system with belts to produce a momentary progressive resistance against a change of direction of the rolling foot-carriage assembly, which the user stands on, providing a resistive exercise motion for the user.

17 Claims, 6 Drawing Sheets

SKI MOTION SIMULATOR MECHANISM FOR A SKI MOTION EXERCISE MACHINE

CROSS-REFERENCE TO RELATED APPLICATION

The present application is related to and claims priority from prior provisional application Ser. No. 61/715,057, filed Oct. 17, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of exercise machines and components and more specifically relates to a ski motion simulator mechanism for a ski motion exercise machine.

DESCRIPTION OF THE RELATED ART

The benefits of exercise have been known since antiquity. Exercise strengthens body muscles and the cardiovascular system to improve overall health and mental outlook. Certain types of sports, activities, or tasks sometimes require certain types of exercises to strengthen the necessary muscles to be able to continue to perform the specific activity. These exercises can be specific resistance movements of the body against an object or isometric resistance exercises against an opposing body part. A proliferation of exercise machines was designed and sold in the last half of the 1900's and continues so far this century for overall body strength and for specific types of exercises to target certain parts of the body.

Many universal type gyms perform the same basic function that free weights perform, however, the universal type gyms usually have a guide rail and pulley system with the added benefit of a limit that the exercise bar can be lowered to. Use of free weights can be more difficult in that the user must not only lift the weight, but be able to control lateral movement of the hoisted weight since there is no guide rail or lowering limit. It has been recognized that having to control lateral movement also strengthens peripheral muscles in the process. Some movements are nearly impossible to effectively mimic with machines though efforts have been made to do so. One type of activity that is difficult to mimic is skiing. Skiing requires the strengthening of specific muscle groups over a wide range of motion with the strengthening of peripheral muscles for lateral movement throughout the range of motion. During the off-season for skiing, these muscles can become weak, and rigid mechanical movement exercisers do not develop all the muscles required. A solution that more closely imitates the resistance in the skiing motion is needed for amateur or professional athletes.

Various attempts have been made to solve the above-mentioned problems such as those found in U.S. Pat. No. 5,503,610 to Daniel F. Brashear; U.S. Pat. No. 2,969,060 to Howard F. Swanda et al; U.S. Pat. No. 5,961,423 to Tyrone D. Sellers; U.S. Pat. No. 4,023,795 to Edward A. Pauls; U.S. Pat. No. 2,274,081 to Francois Mautin et al; and U.S. Pat. No. 3,941,377 to Hakon Lie. This art is representative of ski motion exercise machines. None of the above inventions and patents, taken either singly or in combination, is seen to describe the invention as claimed.

Ideally, a ski motion simulator mechanism for a ski motion exercise machine should be user-friendly and closely mimic skiing resistance motion to optimally benefit the user and, yet would operate reliably and be manufactured at a modest expense. Thus, a need exists for a reliable ski motion simulator mechanism for a ski motion exercise machine to avoid the above-mentioned problems.

BRIEF SUMMARY OF THE INVENTION

In view of the foregoing disadvantages inherent in the known ski motion exercise machine art, the present invention provides a novel ski motion simulator mechanism for a ski motion exercise machine. The general purpose of the present invention, which will be described subsequently in greater detail, is to provide an apparatus to accurately mimic skiing resistance motion to as to properly train and condition its users.

The ski motion simulator mechanism is an apparatus that may be attached to an existing ski motion exercise machine that is useful for simulating a downhill skiing resistance motion and strengthening the muscle groups used in skiing to prevent injuries and to maintain muscle tone for these muscle groups during the off-season. The ski motion simulator mechanism for a ski motion exercise machine may comprise a ski motion simulator mechanism having a rolling foot-carriage assembly with a plurality of foot placement receivers, at least one belt guide roller, at least one belt press roller, a beltchute, a drum housing, a press handle, a inclined plane plunger, a disc of multiple tiny rollers, a plurality of carriage rollers, a top plate having a first side and a second side, a base plate having a top side and a bottom side, a flywheel, a left multi-belt pulley, a right multi-belt pulley, and a first motion belt and second motion belt. The ski motion simulator mechanism may be operatively attached to an existing ski motion exercise machine as an improved resistive motion producing mechanism.

The rolling foot-carriage assembly is rollably positioned atop the roller tracks of the ski-motion exercise machine so that the user is able to stand placing his feet in the foot placement receivers and perform a side to side sliding motion, simulating a downhill skiing resistance motion. The foot placement receivers are attached to the first side of the top plate with the plurality of foot placement receivers positioned parallel to each other, and perpendicular to the roller tracks of the ski motion exercise machine. The second side of the top plate is non-removably attached parallel planar and adjacent to the top side of the base plate. The rolling foot-carriage assembly may further comprise the retainer bracket mounted to the bottom side of the base plate for sliding the drum housing with the belt guide rollers and mounting the belt guide rollers such that the central axis of the belt guide rollers are (substantially) perpendicular to the base plate. The drum housing further may comprise an enclosure with shelves, by which the belt guide rollers are attached, and a thumbwheel and screw for slide-adjusting the drum housing itself. The slide adjustment for the drum housing may comprise a forward position and a back position. The back position decreases the distance between feet placement of the forward and backward positions of the rolling foot-carriage assembly and the back position increases a distance between feet placement of the forward and the backward positions of the rolling foot-carriage assembly. The back position may be used for less experienced skiers and the forward position may be used for more experienced skiers.

The rolling foot-carriage assembly may further comprise a belt press roller housing, an inclined plane and spring loaded plunger, a spring loaded press handle, and a drum housing, all in cooperative communication. The belt press rollers may preferably comprise 2 wheels each positioned in a side by side configuration with the second motion belt serpentine weaved through the 2 wheels. The carriage rollers are rotatably attached to the bottom side of the base plate and the axles for the carriage rollers are nestably mounted in and coplanar to the base plate such that the carriage rollers are able to roll the rolling foot-carriage assembly laterally along the roller tracks of the ski-motion exercise machine.

The flywheel is rotatably mounted to the framework of the underside of the ski-motion exercise machine, parallel planar to the top pulleys at the ends of track. The flywheel may be a weighted rotatable disc for generating a directional momentum and may be about 3 feet in diameter, but may also be smaller or larger in some embodiments. The belt axle of the flywheel is concentrically located on one side of the flywheel and may comprise grooves about the outer circumference such that the first motion belt is able to stay within the grooves during rotation. The left and right multi-belt pulleys are each rotatably mounted to the framework of the underside of the ski-motion exercise machine with the left multi-belt pulley and the right multi-belt pulley axially parallel to the flywheel and each mounted on opposing sides of the flywheel.

The first motion belt comprises a first endless loop with the inner periphery frictionally and rotatably contacting the outer circumference of the belt axle of the flywheel and the first outer periphery of the left multi-belt pulley and the first outer periphery of the right multi-belt pulley. During rotation, the flywheel is able to produce a momentary progressive resistance against a change of direction of the rolling foot-carriage assembly providing a resistive exercise motion for the user.

The second motion belt is similarly a second endless loop with the inner side of the second motion belt frictionally and rotatably contacting a second outer periphery of the left multi-belt pulley and the second outer periphery of the right multi-belt pulley. The second motion belt is frictionally and tensionally adjusted via at least one belt press roller of the rolling foot-carriage assembly such that a lateral movement of the rolling foot-carriage assembly is able to rotate the left multi-belt pulley and the right multi-belt pulley. The ski motion simulator mechanism may be used as a retrofit to an existing ski motion exercise machine or may be factory installed on new machines.

The ski motion simulator mechanism may be offered as a kit having a fully (or partially) assembled rolling foot-carriage assembly, a flywheel, a left multi-belt pulley, a right multi-belt pulley, a first motion belt, a second motion belt, and a set of user instructions. A method of use for the ski motion simulator mechanism may include the steps of placing the left user's foot and the right user's foot on the rolling foot-carriage assembly of the ski motion exercise machine, gripping the hand bar of the ski motion exercise machine, and shifting the user's weight laterally side to side to simulate a downhill ski motion performing an exercise.

The present invention holds significant improvements and serves as a ski motion simulator mechanism for use with a ski motion exercise machine. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, ski motion simulator mechanism for a ski motion exercise machine, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a ski motion exercise machine and more particularly to a ski motion simulator mechanism for a ski motion exercise machine as used to improve a workout routine performing mimicked skiing resistance motion.

Generally speaking, the ski motion simulator mechanism for a ski motion exercise machine is a mechanism that can be retrofitted to an existing ski motion exercise machine or may be installed on new machines by the manufacturer. The device preferably utilizes a weighted flywheel and pulley system with belts to produce a momentary progressive resistance against a change of direction of the rolling foot-carriage assembly providing a resistive exercise motion for the user.

Figure 1:
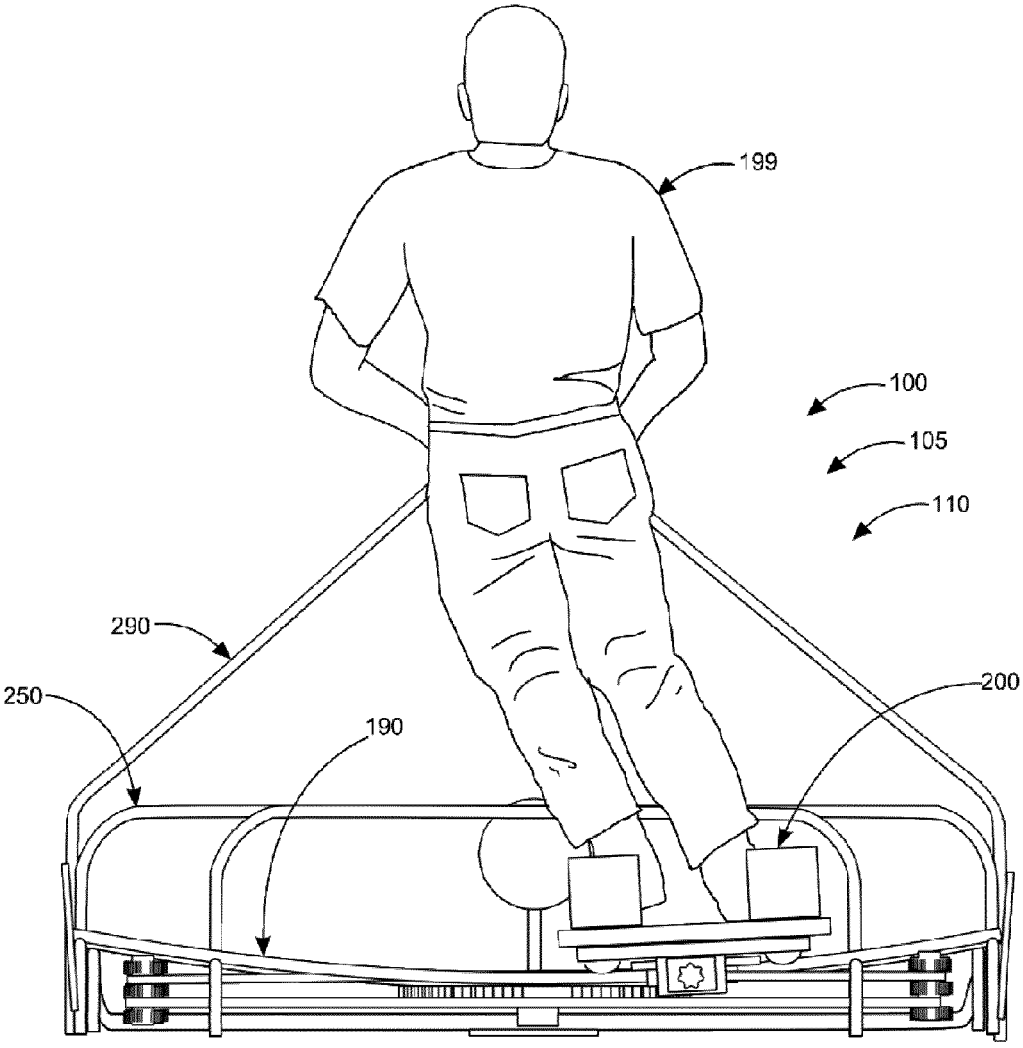
FIG. 1 shows a perspective view illustrating an in-use condition of a ski motion simulator mechanism for a ski motion exercise machine according to an embodiment of the present invention.

Referring to the drawings by numerals of reference there is shown in FIG. 1 a perspective view illustrating an in-use condition of ski motion simulator mechanism for a ski motion exercise machine 100 according to an embodiment of the present invention.

Ski motion simulator mechanism 105 comprises an apparatus that may be attached to an existing ski motion exercise machine 110 that is useful for simulating a downhill skiing resistance motion and strengthening muscle groups used in skiing to prevent injuries and to maintain muscle tone for these muscle groups during an off-season. Ski motion simulator mechanism 105 uses flywheel 120 in conjunction with left multi-belt pulley 130, right multi-belt pulley 140, first motion belt 150, and second motion belt 160 to produce a realistic progressive resistance again strolling foot-carriage assembly 170.

Figure 2:
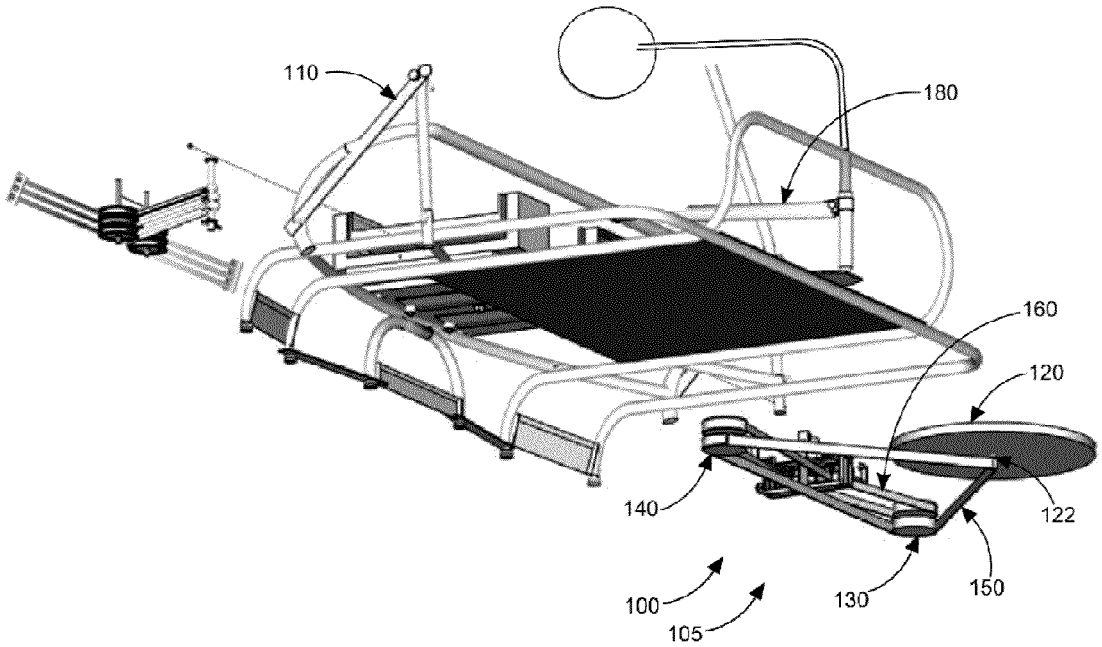
FIG. 2 is a lower perspective view illustrating an existing motion device to the left and a ski motion simulator mechanism for a ski motion exercise machine to the right, according to an embodiment of the present invention of FIG. 1.

Referring now to FIG. 2, a lower perspective view illustrating an existing motion device to the left and ski motion simulator mechanism for a ski motion exercise machine 100 to the right, according to an embodiment of the present invention of FIG. 1.

Ski motion simulator mechanism 105 may be operatively attached to an existing ski motion exercise machine 110 as an improved resistive motion producing mechanism. Rolling foot-carriage assembly 170 is preferably rollably positioned atop roller tracks 190 of ski motion exercise machine 110 so that user 199 is able to stand placing his feet in foot placement receivers 200 and perform a side to side sliding motion, simulating a downhill skiing resistance motion.

Figure 3A:
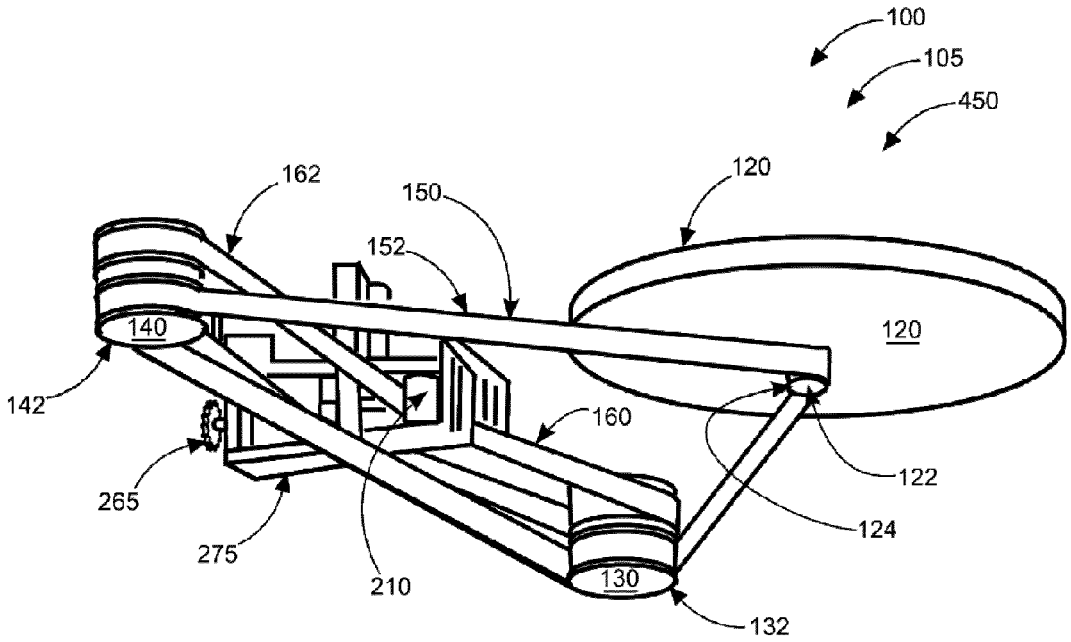
FIG. 3A is a lower perspective view illustrating an assembled ski motion simulator mechanism for a ski motion exercise machine according to an embodiment of the present invention of FIG. 1.
Figure 3B:
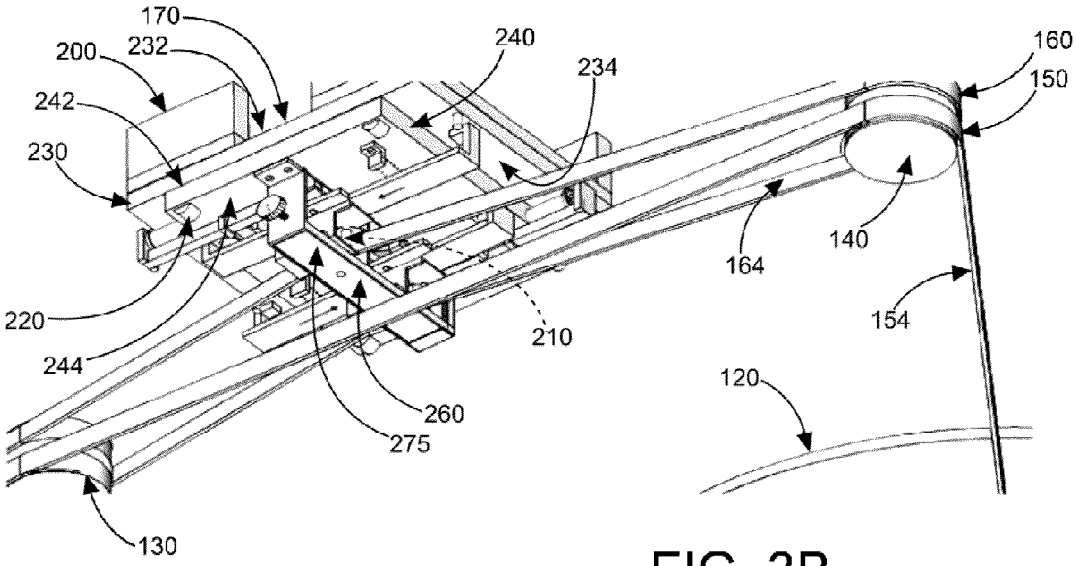
FIG. 3B is another lower perspective view illustrating an assembled ski motion simulator mechanism for a ski motion exercise machine according to an embodiment of the present invention of FIG. 1.

Referring now to FIGS. 3A and 3B, are lower perspective views illustrating an assembled ski motion simulator mechanism for a ski motion exercise machine 100 both according to an embodiment of the present invention of FIG. 1.

Ski motion simulator mechanism 105 may comprise rolling foot-carriage assembly 170 with foot placement receivers 200, at least one belt guide roller(s) 210, a plurality of carriage rollers 220, top plate 230 having first side 232 and second side 234, base plate 240 having top side 242 and bottom side 244, flywheel 120, left multi-belt pulley 130, right multi-belt pulley 140, and first motion belt 150 and second motion belt 160.

Flywheel 120 is rotatably mounted to framework 250 of the underside of ski motion exercise machine 110, parallel planar to base plate 240 and top plate 230. Flywheel 120 may be a weighted rotatable disc for generating a directional momentum and may be about 3 feet in diameter, but may also be smaller or larger in some embodiments. Belt axle 122 of flywheel 120 is concentrically located on one side of flywheel 120 and may comprise grooves about outer circumference 124 such that first 150 and second motion belt 160 are able to stay within the grooves during rotation. Left multi-belt pulley 130 and right multi-belt pulley 140 are each rotatably mounted to framework 250 of the underside of ski motion exercise machine 110 with left multi-belt pulley 130 and right multi-belt pulley 140 axially parallel to flywheel 120 and each mounted on opposing sides of flywheel 120.

First motion belt 150 comprises first endless loop 152 with inner periphery 154 frictionally and rotatably contacting outer circumference 124 of belt axle 122 of flywheel 120 and first outer periphery 132 of left multi-belt pulley 130 and first outer periphery 142 of right multi-belt pulley 140. During rotation, flywheel 120 is able to produce momentary progressive resistance against change of direction of rolling foot-carriage assembly 170 providing resistive exercise motion for user 199.

Figure 4A:
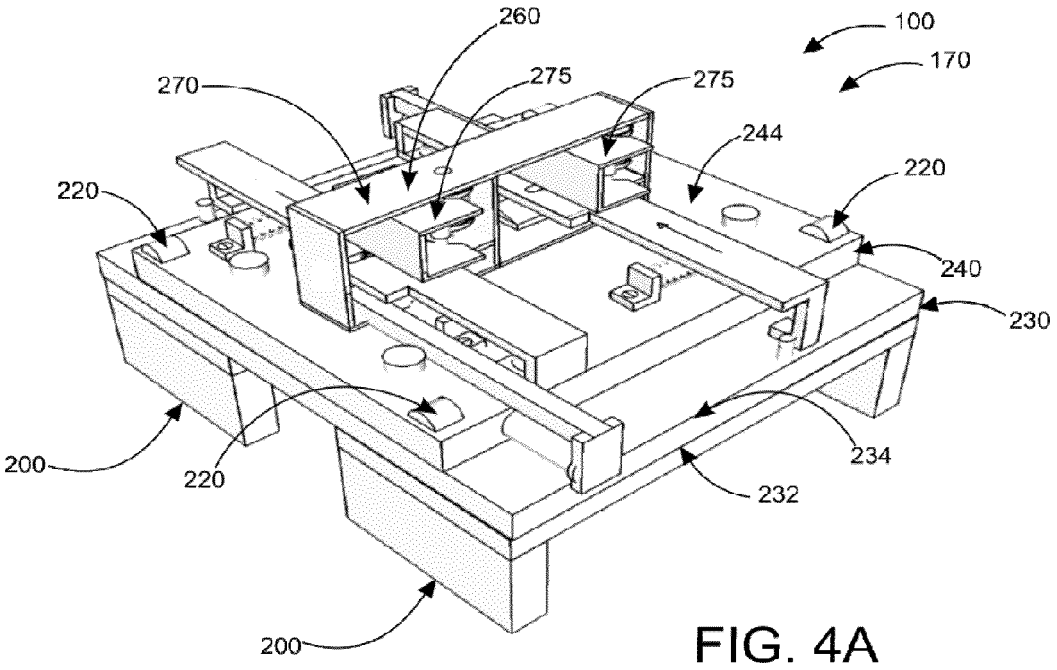
FIG. 4A and FIG. 4B are inverted perspective views illustrating the rolling foot-carriage assembly of the ski motion simulator mechanism for a ski motion exercise machine according to an embodiment of the present invention of FIG. 1.
Figure 4B:
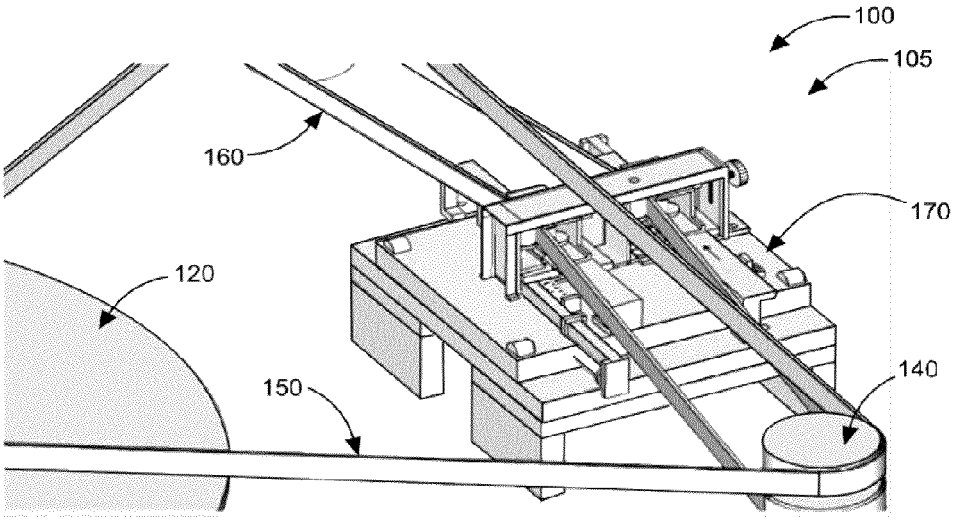

Referring now to FIG. 4A and FIG. 4B, which are inverted perspective views illustrating rolling foot-carriage assembly 170 of ski motion simulator mechanism for a ski motion exercise machine 100 according to an embodiment of the present invention of FIG. 1.

Foot placement receivers 200 are attached to first side 232 of top plate 230 with foot placement receivers 200 positioned parallel to each other, and perpendicular to roller tracks 190 of ski motion exercise machine 110. Second side 234 of top plate 230 is non-removably attached parallel planar and adjacent to top side 242 of base plate 240. Rolling foot-carriage assembly 170 further may comprise drum housing 260 mounted to bottom side 244 of base plate 240 for mounting belt guide roller(s) 210 such that the central axis of belt guide roller(s) 210 are perpendicular to base plate 240. Retainer bracket 270 further may comprise thumbwheel and screw 265 for slide-adjusting drum housing 260 thru belt chute 282.

The slide adjustment for drum housing 260 may comprise a forward position and a back position. The back position decreases distance between feet placement of forward and backward positions of rolling foot-carriage assembly 170 and the forward position increases a distance between the feet of the forward and backward positions of rolling foot-carriage assembly 170. The back position may be used for lesser experienced skiers and forward position may be used for more experienced skiers.

Figure 5:
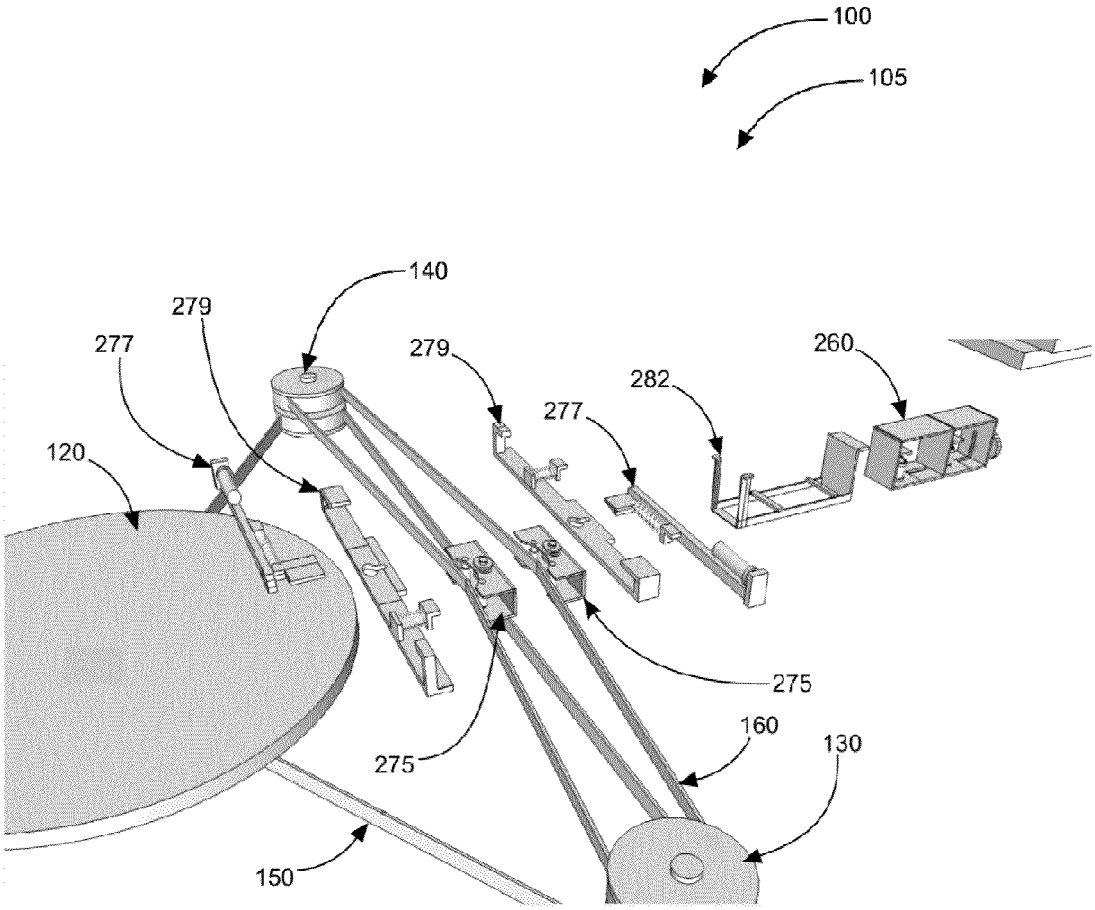
FIG. 5 is an exploded view illustrating a ski motion simulator mechanism for a ski motion exercise machine according to an embodiment of the present invention of FIG. 1.

Referring now to FIG. 5 is an exploded view illustrating ski motion simulator mechanism for a ski motion exercise machine 100 according to an embodiment of the present invention of FIG. 1.

Rolling foot-carriage assembly 170 may further comprise belt guide roller housing 275, inclined plane and spring loaded plunger 277, spring loaded press handle 279, and drum housing 260 in cooperative communication. Belt press roller(s) 210 may comprise two wheels (in preferred embodiments) each positioned in a side by side configuration with second motion belt 160 serpentine weaved through the 2 wheels. Carriage rollers 220 are rotatably attached to bottom side 244 of base plate 240 and the axles for carriage rollers 220 are nestably mounted in and coplanar to base plate 240 such that carriage rollers 220 are able to roll rolling foot-carriage assembly 170 laterally along roller tracks 190 of ski motion exercise machine 110.

Second motion belt 160 comprises second endless loop 162 with inner side 164 of second motion belt 160 frictionally and rotatably contacting first outer periphery 132 of left multi-belt pulley 130 and second outer periphery 142 of right multi-belt pulley. Second motion belt 160 is frictionally and tensionally adjusted via at least one belt guide roller(s) 210 of rolling foot-carriage assembly 170 such that a lateral movement of rolling foot-carriage assembly 170 is able to rotate left multi-belt pulley 130 and right multi-belt pulley 140. Ski motion simulator mechanism 105 may be used as a retrofit to an existing ski motion exercise machine 110 or may be factory installed on new machines.

Ski motion simulator mechanism for a ski motion exercise machine 100 may be sold as kit 450 comprising the following parts: at least one fully assembled rolling foot-carriage assembly 170; at least one flywheel 120; at least one left multi-belt pulley 130; at least one right multi-belt pulley 140; at least one first motion belt 150; at least one second motion belt 160; and at least one set of user instructions. Partially assembled versions may be sold The kit has instructions such that functional relationships are detailed in relation to the structure of the invention (such that the invention can be used, maintained, or the like in a preferred manner). Ski motion simulator mechanism for a ski motion exercise machine 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different wheel/component combinations, parts may be sold separately, etc., may be sufficient.

Figure 6:
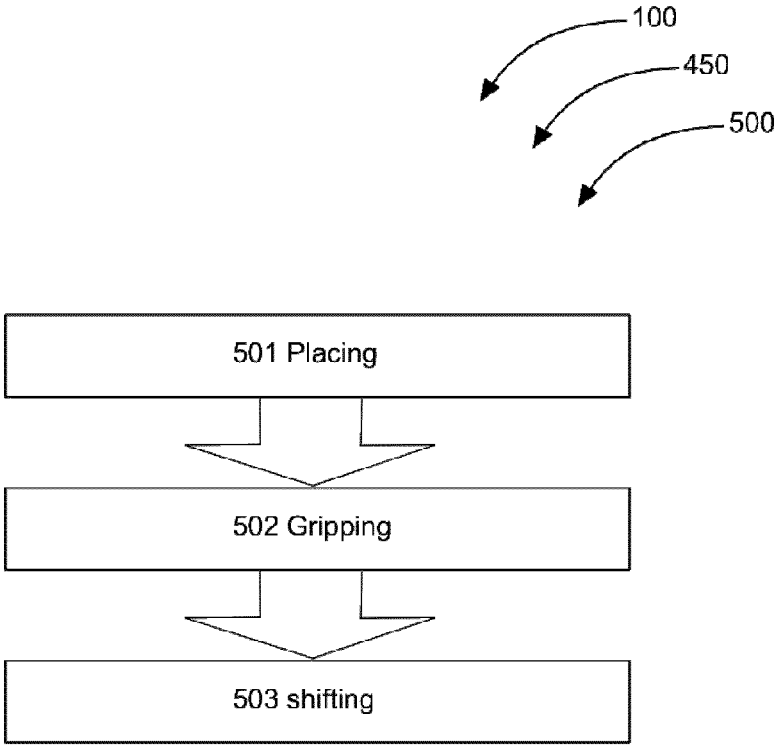
FIG. 6 is a flow chart illustrating a method of use for the ski motion simulator mechanism for a ski motion exercise machine according to an embodiment of the present invention of FIG. 1.

Referring now to FIG. 6, showing method of use 500 for ski motion simulator mechanism for a ski motion exercise machine 100. A method of using (method of use 500) ski motion simulator mechanism for a ski motion exercise machine 100 may comprise the steps of step one 501 placing the left user's foot and the right user's foot on rolling foot-carriage assembly 170 of ski motion exercise machine 110; step two 502 gripping hand bar 290 of ski motion exercise machine 110; step three 503 shifting user's 199 weight laterally side to side to simulate a downhill ski motion and performing an exercise.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A ski motion simulator mechanism for a ski motion exercise machine comprising:

a ski motion simulator mechanism having;

a rolling foot-carriage assembly having;

a plurality of foot placement receivers;

a plurality of swivel and swingable receiver rollers;

at least one belt guide roller;

at least one belt press roller;

at least one inclined plane plunger;

at least one press handle;

a plurality of carriage rollers;

a top plate having a first side and a second side; and a base plate having a top side and a bottom side;

a disc of multiple tiny rollers between rotatable top plate and base plate as carriage;

a flywheel;

a left multi-belt pulley;

a right multi-belt pulley;

a first motion belt; and a second motion belt;

wherein said ski motion simulator mechanism is operatively attached to a ski motion exercise machine;

wherein said rolling foot-carriage assembly is rollably positioned atop at least one roller track of said ski-motion exercise machine;

wherein said plurality of foot placement receivers are attached to a first side of said top plate, said plurality of foot placement receivers positioned parallel to each other and perpendicular to said at least one roller track of said ski motion exercise machine;

wherein said second side of said top plate is non-removably attached parallel planar and adjacent to said top side of said base plate;

wherein said at least one belt guide roller is mounted to a bottom side of said base plate such that a central axis of said at least one belt guide roller is perpendicular to said base plate, said base plate attached to said rolling foot-carriage assembly;

wherein said plurality of carriage rollers are rotatably attached to said bottom side of said base plate, a plurality of axles for said carriage rollers nestably mounted and coplanar to said base plate such that said carriage rollers are able to roll said rolling foot-carriage assembly laterally along said at least one roller track of said ski-motion exercise machine;

wherein said flywheel is rotatably mounted to a framework of an underside of said ski-motion exercise machine, parallel planar to said base plate and said top plate;

wherein said left multi-belt pulley and said right multi-belt pulley are each rotatably mounted to said framework of said underside of said ski-motion exercise machine, said left multi-belt pulley and said right multi-belt pulley axially parallel to said flywheel and each mounted on opposing sides of said flywheel;

wherein said first motion belt is a first endless loop, an inner periphery of said first motion belt frictionally and rotatably contacting an outer circumference of a belt axle of said flywheel and a first outer periphery of said left multi-belt pulley and a first outer periphery of said right multi-belt pulley;

wherein said second motion belt is a second endless loop, an inner side of said second motion belt frictionally and rotatably contacting said second outer periphery of said left multi-belt pulley and said second outer periphery of said right multi-belt pulley;

wherein said second motion belt is frictionally and tensionally adjusted via said at least one belt guide roller of said rolling foot-carriage assembly such that a lateral movement of said rolling foot-carriage assembly is able to rotate said left multi-belt pulley and said right multi-belt pulley; and wherein said ski motion simulator mechanism is useful for simulating a downhill skiing resistance motion and strengthening a muscle group used in skiing to prevent injuries and to maintain muscle tone for said muscle group.

2. The ski motion simulator mechanism for a ski motion exercise machine of claim 1 wherein said ski motion simulator mechanism is an alternate motion producing mechanism for an existing ski motion exercise machine.

3. The ski motion simulator mechanism for a ski motion exercise machine of claim 1 wherein a user is able to stand placing said user's feet in said plurality of foot placement receivers and perform a side to side sliding motion, which is able to activate said simulated downhill skiing resistance motion.

4. The ski motion simulator mechanism for a ski motion exercise machine of claim 1 wherein said rolling foot-carriage assembly further comprises a drum housing for mounting said at least one belt guide roller.

5. The ski motion simulator mechanism for a ski motion exercise machine of claim 4 wherein said at least one belt guide roller comprises 3 wheels each.

6. The ski motion simulator mechanism for a ski motion exercise machine of claim 4 wherein said second motion belt is serpentine weaved through said 3 wheels of said said at least one belt guide roller.

7. The ski motion simulator mechanism for a ski motion exercise machine of claim 3 wherein said flywheel is about 3 feet in diameter.

8. The ski motion simulator mechanism for a ski motion exercise machine of claim 7 wherein said flywheel is a weighted rotatable disc.

9. The ski motion simulator mechanism for a ski motion exercise machine of claim 8 wherein said belt axle of said flywheel is concentrically located on one side of said flywheel.

10. The ski motion simulator mechanism for a ski motion exercise machine of claim 9 wherein said belt axle comprises a groove about an outer circumference such that said first motion belt is able to stay within said groove during a rotation.

11. The ski motion simulator mechanism for a ski motion exercise machine of claim 9 wherein a rotating said flywheel is able to produce a momentary progressive resistance against a change of direction of said rolling foot-carriage assembly providing a resistive exercise motion for said user.

12. The ski motion simulator mechanism for a ski motion exercise machine of claim 1 wherein said rolling foot-carriage assembly further comprises a belt guide roller housing, said inclined plane and spring loaded plunger, a spring loaded press handle, and a drum housing in cooperative communication.

13. The ski motion simulator mechanism for a ski motion exercise machine of claim 4 wherein said retainer bracket further comprises a thumbwheel and screw for slide-adjusting said drum housing.

14. The ski motion simulator mechanism for a ski motion exercise machine of claim 4 wherein said slide adjustment for said drum housing comprises a forward position and a back position.

15. The ski motion simulator mechanism for a ski motion exercise machine of claim 14 wherein said back position decreases a distance between feet placement of the forward and backward positions of said rolling foot-carriage assembly and said back position increases a distance between feet of said forward and said backward positions of said rolling foot-carriage assembly.

16. A ski motion simulator mechanism for a ski motion exercise machine comprising:

a ski motion simulator mechanism having;

a rolling foot-carriage assembly having;

a plurality of foot placement receivers;

a plurality of swivel and swing able receiver rollers;

at least one belt guide roller;

at least one belt press roller;

at least one wedge plunger;

at least one press handle;

a plurality of carriage rollers;

a top plate having a first side and a second side; and a base plate having a top side and a bottom side;

a disc of multiple tiny rollers between rotatable top plate and base plate as carriage;

a flywheel;

a left multi-belt pulley;

a right multi-belt pulley;

a first motion belt; and a second motion belt;

wherein said ski motion simulator mechanism is operatively attached to a ski motion exercise machine;

wherein said ski motion simulator mechanism is an alternate motion producing mechanism for an existing ski motion exercise machine;

wherein said rolling foot-carriage assembly is rollably positioned atop at least one roller track of said ski-motion exercise machine;

wherein a user is able to stand placing said user's feet in said plurality of foot placement receivers and perform a side to side sliding motion, which is able to activate said simulated downhill skiing resistance motion;

wherein said plurality of foot placement receivers are attached to a first side of said top plate, said plurality of foot placement receivers positioned parallel to each other and perpendicular to said at least one roller track of said ski motion exercise machine;

wherein said second side of said top plate is non-removably attached parallel planar and adjacent to said top side of said base plate;

wherein said at least one belt guide roller is mounted to a bottom side of said base plate such that a central axis of said at least one belt guide roller is perpendicular to said base plate, said base plate attached to said rolling foot-carriage assembly;

wherein said rolling foot-carriage assembly further comprises a drum housing for mounting said at least one belt guide roller;

wherein said retainer bracket further comprises a thumbwheel and screw for slide-adjusting said drum housing;

wherein said slide adjustment for said drum housing comprises a forward position and a back position;

wherein said back position decreases a distance between feet placement of the forward and backward positions of said rolling foot-carriage assembly and said back position increases a distance between feet of said forward and said backward positions of said rolling foot-carriage assembly;

wherein said rolling foot-carriage assembly further comprises a belt guide roller housing, an inclined plane and spring loaded plunger, a spring loaded press handle, and a drum housing in cooperative communication;

wherein said at least one belt guide roller comprises 3 wheels each;

wherein said second motion belt is serpentine weaved through said 3 wheels of said at least one belt guide roller;

wherein said plurality of carriage rollers are rotatably attached to said bottom side of said base plate, a plurality of axles for said carriage rollers nestably mounted and coplanar to said base plate such that said carriage rollers are able to roll said rolling foot-carriage assembly laterally along said at least one roller track of said ski-motion exercise machine;

wherein said flywheel is rotatably mounted to a framework of an underside of said ski-motion exercise machine, parallel planar to said base plate and said top plate;

wherein said flywheel is a weighted rotatable disc;

wherein said flywheel is about 3 feet in diameter;

wherein said belt axle of said flywheel is concentrically located on one side of said flywheel;

wherein said belt axle comprises a groove about an outer circumference such that said first motion belt is able to stay within said groove during a rotation;

wherein said left multi-belt pulley and said right multi-belt pulley are each rotatably mounted to said framework of said underside of said ski-motion exercise machine, said left multi-belt pulley and said right multi-belt pulley axially parallel to said flywheel and each mounted on opposing sides of said flywheel;

wherein said first motion belt is a first endless loop, an inner periphery of said first motion belt frictionally and rotatably contacting an outer circumference of a belt axle of said flywheel and a first outer periphery of said left multi-belt pulley and a second outer periphery of said right multi-belt pulley;

wherein a rotating said flywheel is able to produce a momentary progressive resistance against a change of direction of said rolling foot-carriage assembly providing a resistive exercise motion for said user;

wherein said second motion belt is a second endless loop, an inner side of said second motion belt frictionally and rotatably contacting said second outer periphery of said left multi-belt pulley and said second outer periphery of said right multi-belt pulley;

wherein said second motion belt is frictionally and tensionally adjusted via said at least one belt guide roller of said rolling foot-carriage assembly such that a lateral movement of said rolling foot-carriage assembly is able to rotate said left multi-belt pulley and said right multi-belt pulley; and wherein said ski motion simulator mechanism is useful for simulating a downhill skiing resistance motion and strengthening a muscle group used in skiing to prevent injuries and to maintain muscle tone for said muscle group.

17. The ski motion simulator mechanism for a ski motion exercise machine of claim 16 further comprising a kit including:

a fully assembled said rolling foot-carriage assembly;

said flywheel;

said left multi-belt pulley;

said right multi-belt pulley;

said first motion belt;

said second motion belt; and a set of user instructions.

* * * * *